United States Patent [19]

Mammone

[11] Patent Number: 4,949,378

[45] Date of Patent: Aug. 14, 1990

[54] TOY HELMET FOR SCRAMBLED COMMUNICATIONS

[76] Inventor: Richard J. Mammone, 112 Nathan Dr., North Brunswick, N.J. 08902

[21] Appl. No.: 483,982

[22] Filed: Feb. 21, 1990

Related U.S. Application Data

[63] Continuation of Ser. No. 93,226, Sep. 4, 1987, abandoned.

[51] Int. Cl.[5] ..... H04K 1/02

[52] U.S. Cl. ..... 380/9; 380/38; 380/39; 380/40

[58] Field of Search ..... 380/9, 38, 39, 40

[56] References Cited

U.S. PATENT DOCUMENTS

| | | | |
|---|---|---|---|
| 3,114,800 | 12/1963 | Simpkins | 380/9 |
| 4,152,553 | 5/1979 | White | 179/156 R |
| 4,195,202 | 3/1980 | McCalmont | 380/9 |
| 4,400,591 | 8/1983 | Jennings et al. | 179/156 R |
| 4,652,699 | 3/1987 | Akaiwa | 380/31 |
| 4,683,586 | 7/1987 | Sakamoto et al. | 380/48 |
| 4,790,009 | 12/1988 | Ishigaki et al. | 380/9 |

*Primary Examiner*—Thomas H. Tarcza
*Assistant Examiner*—David Cain
*Attorney, Agent, or Firm*—Howard R. Popper

[57] ABSTRACT

A toy helmet that permits the wearer to speak as to generate unintelligible noise so far as bystanders are concerned but which can be understood by another child wearing an identical helmet. Each helmet is equipped with internal and external microphones and an external speaker and internal earphones. Scrambler/descrambler circuitry is selectively connectable by means of a push-to-talk switch that delivers speech from the internal microphone to the external loudspeaker of the first helmet. The external microphone and the corresponding scambler/descrambler circuitry and push-to-talk switch of the second helmet delivers unscrambled speech to its internal earphone to permit the two helmet wearers to communicate intelligibly with one another. The scrambler/descrambler circuitry samples the low-pass filtered signals applied to its microphones at a sampling rate equal to the cut-off frequency of the low-pass filter.

10 Claims, 4 Drawing Sheets

TOY HELMET FOR SCRAMBLED COMMUNICATIONS

This application is a continuation of Ser. No. 93,226, filed 4 Sept. 1987, now abandoned.

BACKGROUND OF THE INVENTION

This invention relates to childrens' toys and, more particularly, to toy masks capable of transmitting and disguising the voice of the wearer.

It has been recognized for a long time that children of a certain age derive a great deal of pleasure from making noise. Children who are somewhat older enjoy communicating with each other using secret codes or languages that parents and others, including other children, cannot understand. A prior art toy mask that disguised the voice of the wearer and also permitted the making of Martian-like sounds is shown in D. E. Jennings, et al. Pat. No. 4,400,591, issued Aug. 23, 1983. In accordance with the disclosure of that patent, electronic circuitry was interposed between a microphone and a loudspeaker mounted in the helmet. The electronics multiplied the voice signal with the output of an oscillator to derive output signals whose amplitudes were the logarithms of the signal inputs at frequencies determined by the algebraic sum and difference of the voice frequency fundamental and the oscillator frequency. None of the original input wave forms appears in the output so that a considerable alteration of the original voice was obtained. The Jennings patent helmet thus seemed to satisfy one of the desires of the child in that it produced unusual speech-releated noise signals. It does not, however, enable children to actually communicate intelligible speech to each other.

While the analog multiplier circuitry taught in the Jennings patent is effective to provide an appropriate noise output, integrated circuit multipliers suffer from two disadvantages; they are expensive and tend to consume a great deal of power thereby shortening useful battery life.

Other helmet communications systems are known such as that shown in M. E. White Pat. No. 4,152,553 issued May 1, 1979 which include sophisticated two-way radio transmitting and receiving equipment. Such systems while effective for intelligible speech communications, lack suitability for use as low-cost noise-producing toys.

SUMMARY OF THE INVENTION

In accordance with the principals of my invention, a voice disguising electronic helmet is provided which is not only capable of producing a suitably distracting audible "noise" output, but is also capable of receiving the noise output from the loudspeaker of a similar helmet and decoding it so that two helmet wearers can communicate intelligibly with each other across a finite distance. Others in the vicinity hear only the noise produced by the helmet wearers but cannot understand the communications that are taking place. Further in accordance with my invention, I overcome the expense and power drain problem of the prior art electronic multiplier device through the use of novel digital scrambling circuitry that samples the speech of the helmet wearer passed through a low-pass filter. More particularly, the circuitry of my invention samples at a rate approximately equal to the high frequency cut off of the low-pass filter. This results in a signal having components of the original speech as well as components whose frequency spectrum is an inversion of the frequency spectrum of the original speed and is largely unintelligible to ordinary listeners. However, since the result of sampling also contains components of the original speech, these must be removed. In accordance with a further aspect of my invention, the components of the original speech remaining in the sampled signal are removed by a subtracting circuit which advantageously comprises an inverting operational amplifier in one parallel branch with the sampling device in the other branch, the two branches being connected by a wired-AND. The output of the wired-AND is low-pass filtered and amplified to derive a speaker that produces unintelligible or "martian-like" replicas of the original speech.

In accordance with a further aspect of my invention, the wearer of another helmet similar to the first will be able to understand the transmitted sound. A pick-up positioned to the outside of the second helmet picks up the inverted speech sounds in the air and applies it to descrambling circuitry that is the conjugate of the scrambling circuitry of the first helmet.

GENERAL DESCRIPTION

Figure 1:
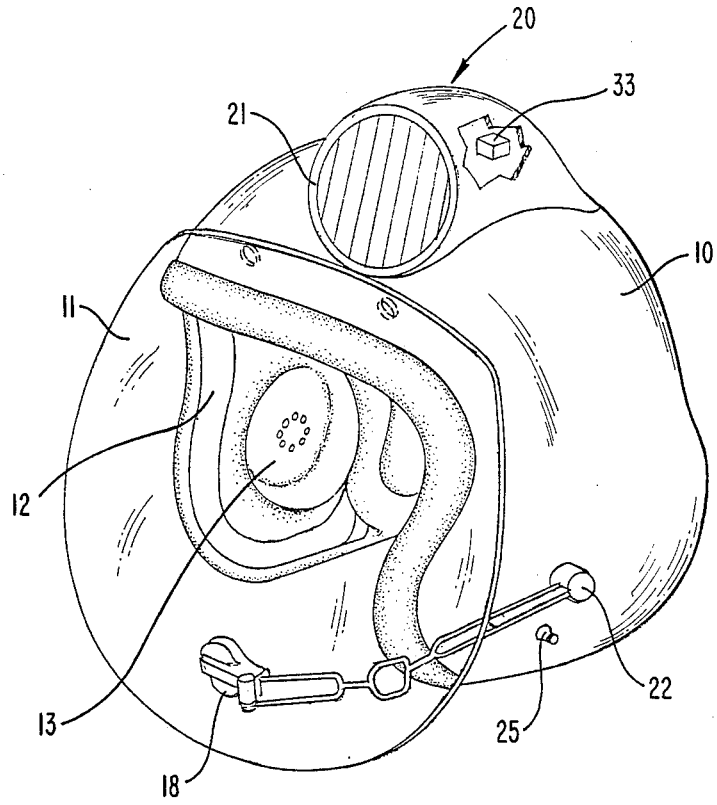
FIG. 1 shows the view of the helmet embodying the children's communications system of my invention.

FIG. 1 shows the helmet apparatus of my invention and includes a basic head section 10, a wholly or partially transparent face mask 11, internal ear phone pair 13, internal microphone 18, external loudspeaker 21, external microphone pick-up 22 and push-to-talk switch 25. The ear phones 13, microphone 18, internal pick-up 22, and loudspeaker 21 are interconnected by the digital speech scrambler/descrambler circuitry 33 mounted inside speaker housing 20. The details of the interconnection are shown in more detail in the remaining figures.

In operation, when the helmet wearer wishes to speak so as to broadcast scrambled speech, push-to-talk switch 25 is operated and the wearer speaks into microphone 18. The wearer's speech is scrambled and amplified by circuitry 33 and delivered to loudspeaker 21 where it emerges into the air as speech that is unintelligible to the ordinary listener. The wearer of a second helmet identical to that shown in FIG. 1 will, however, be able to understand the scrambled speech that is received by pick-up 22 of the second helmet. The signals so received are delivered to circuitry 33 of the second helmet where they are restored to intelligible speech and are applied to ear phone pair 13 so that they may be understood by the wearer of the second helmet.

DETAILED DESCRIPTION

Figure 2:
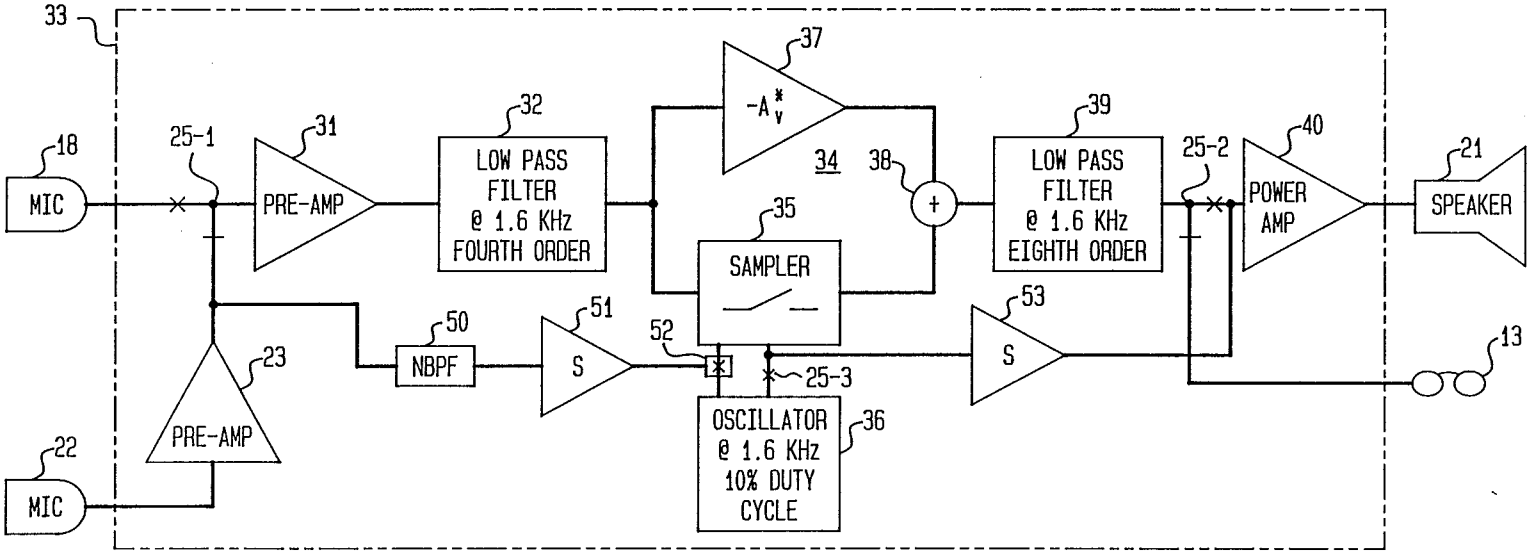
FIG. 2 is a block diagram of the circuitry comprising an illustrative embodiment of my digital scrambler used in the communications of FIG. 1.

Referring now to FIG. 2, a block diagram of the digital scrambler/descrambler circuit 33 of my invention is shown. Microphone 18 corresponds to the similarly numbered element of FIG. 1. When push-to-talk switch 25 is operated, signals from microphone 18 are applied over make contacts 25-1 to preamplifier 31 and, in turn, to low-pass filter 32. Advantageously, low-pass filter 32 has a cut-off frequency $\omega_c$ equivalent to 1600 Hz which is roughly half the nominal telephone "base" band of 3 kHz. Filter 32 is shown in more detail in FIG. 5. The output of low-pass filter 32 is applied to parallel branch circuitry 34. The lower branch of circuitry 34 includes sampling switch 35 which is driven by sampling oscillator 36 whose frequency $\omega_s$ is substantially equivalent to the cutoff frequency (illustratively 1600 Hz) of low-pass filter 32. The upper branch of circuitry 34 comprises inverting amplifier 37. The two branches are connected by summer 30 which advantageously may be a simple wired-AND circuit. The gain of amplifier 37 is adjusted as hereinafter described. The output of AND circuit 38 is applied to low-pass filter 39 and, in turn, over operated make contacts 25-2 to output amplifier 40 for delivery to loudspeaker 21 which corresponds to the similarly numbered element in FIG. 1.

At the same time that push-to-talk switch 25 is operated to connect microphone 18 to preamp 31 over operated make contacts 25-1, operated make contacts 25-3 connect the carrier frequency output $\omega_c$ of oscillator 36 through isolating amplifier 53 to the input of power amplifier 40 for delivery to loudspeaker 21. Accordingly, the loudspeaker output comprises scrambled speech and substantial energy at the carrier frequency $\omega_c$.

Figure 3:
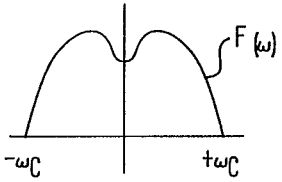
FIG. 3 shows a Fourier transform representation of the frequency spectrum at the output of low-pass filter 32.
Figure 6:
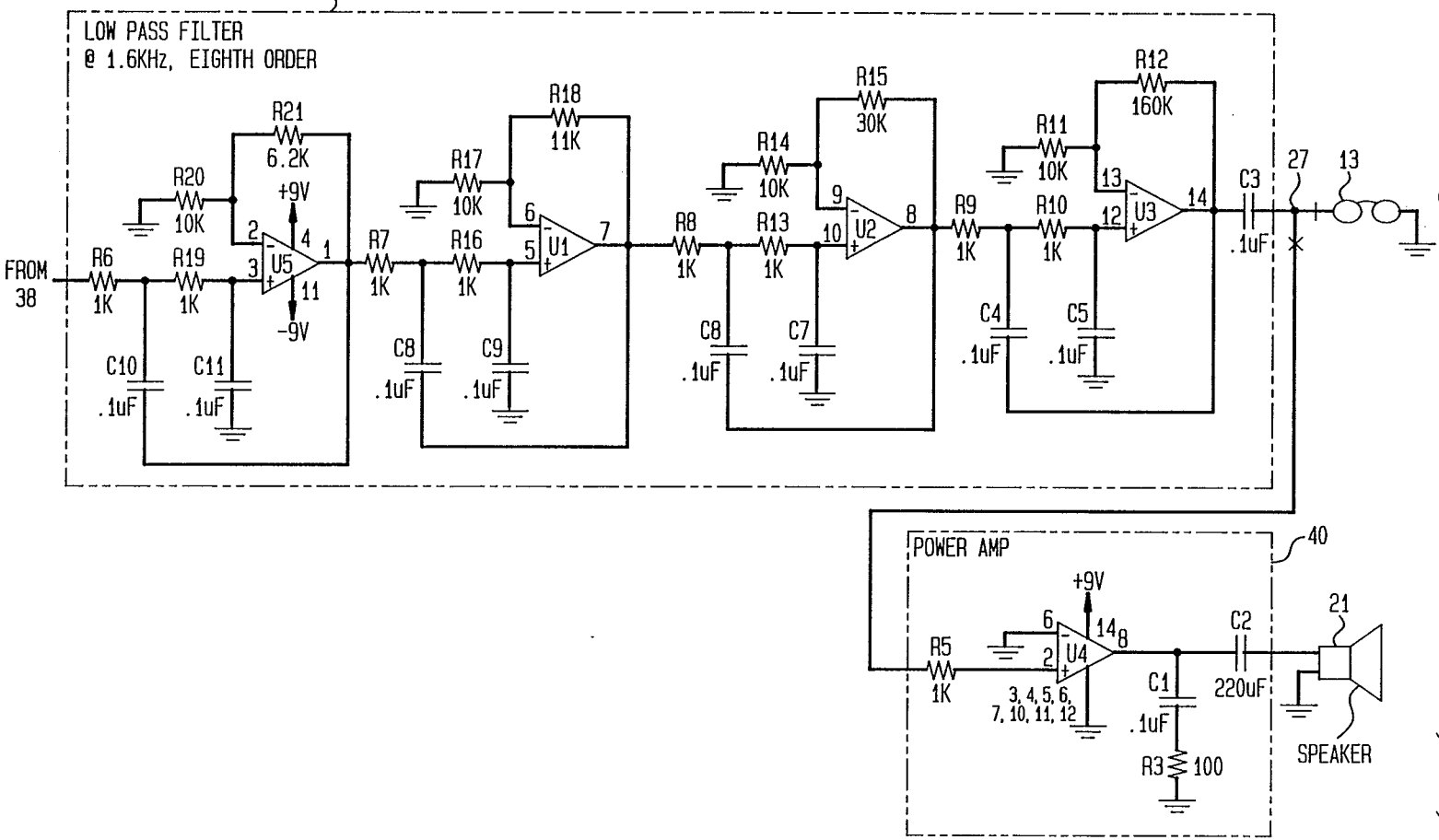

Referring now to FIG. 3, I show a Fourier transform representation $F(\omega)$ of the base band speech signal appearing at the output of fourth order low-pass filter 32. Here, $\omega_c$ represents the cut-off frequency of the filter, illustratively 1600 Hz, and the baseband spectrum extends from $-\omega_c$ to $+\omega_c$. As shown in FIG. 6 low-pass filter 32 may advantageously comprise a pair of serially connected LB324 operational amplifiers.

Figure 4:
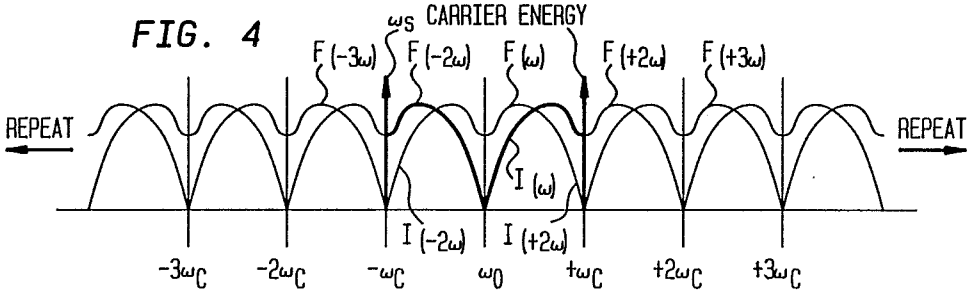
FIG. 4 shows a Fourier transform representation of the frequency spectrum at the output of sampler 35.

The output of sampler 35 is shown in Fourier transform representation in FIG. 4. Here the frequency $\omega_s$ of sampling oscillator 36 is substantially equal to the cutoff frequency $\omega_c$ of low-pass filter 32. FIG. 4 shows that the sampled low-pass filtered speech comprises an overlapping, multiple iteration of the baseband wave form $F(\omega)$ of FIG. 3 of which only illustrative iterations, $F(-3\omega\ s)$, $F(-2\omega\ s)$, $F(\omega\ s)$, $F(2\omega\ s)$, and $F(3\omega\ s)$ are shown. In base band region from $-\omega_c$ to $+\omega_c$ the original speech component $F(\omega)$ exists as well as the right hand half of the spectrum $F(-2\omega\ s)$ and the left hand half of the spectrum $F(+2\omega\ s)$, both portions shown in heavy outline at $I(\omega)$. The output of inverting amplifier 37 is advantageously adjusted to substantially equal the negative of the magnitude of the base band original speech component $F(\omega)$ thereby leaving primarily only $I(\omega)$ which is shown in heavy outline and which is comprised of the inverted or scrambled components $F(-2\omega\ s)$ and $F(+2\omega\ s)$ in the region between $-\omega_c$ and $+\omega_c$. Low-pass filter 39 simply removes from FIG. 4 all spectra in the regions above $+\omega_c$ and below $-\omega_c$. Note the presence of the carrier signal, $\omega_s$, energy at $\pm\omega_c$. At the second helmet, which is identical to that of FIGS. 1 and 2, the inverted base band speech, $I(\omega)$, shown in heavy outline between $-\omega_c$ and $+\omega_c$ in FIG. 4, as well as the carrier signal energy, are picked up by external microphone 22.

Figure 5:
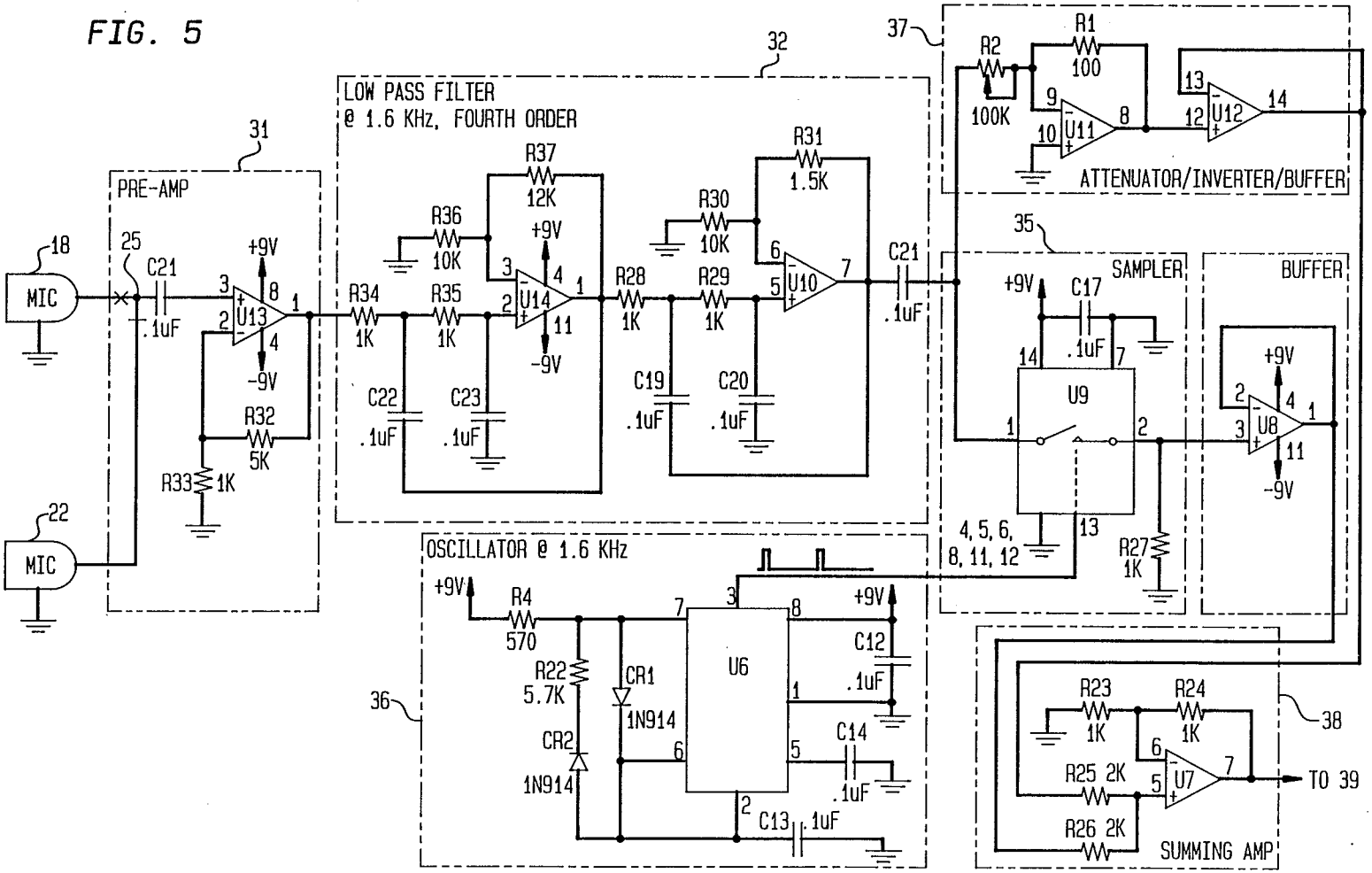
FIGS. 5 and 6 show the detailed circuitry depicted in the block diagram of FIG. 2.

FIGS. 5 and 6 show the details of the correspondingly numbered blocks of FIG. 2 (except for components 50, 51, 52, 25-3 and 53) which have been omitted for the sake of clarity. Inverting amplifier 37 advantageously comprises a pair of serially-connected LM324 op-amps, while sampler 35 comprises a 4086 switch, oscillator 36 employs NE555 circuitry and eighth order low-pass filter 39 comprises four serially-connected LM324 amplifiers. In the illustrative embodiment the capacitors and resistors had the values shown in the drawing.

Referring now to FIG. 2, the wearer of the second helmet, desiring to unscramble the noise in the air, does not operate switch 25. The inverted speech picked up by microphone 22 is amplified by pre-amp 23 and applied to narrow band pass filter 50, filter 50 as a pass band of not more than about 500 Hz centered at the carrier frequency $\omega_s$, illustratively 1600 Hz. However, sufficient $\omega_s$ carrier energy is passed by the filter 50 to integrating amplifier 51. Amplifier 51 operates voltage control switch 52. The operation of voltage control switch 52 allows oscillator 36 to drive sampler 35 as described above in connection with the scrambling operation. Simultaneously with the delivery of the signals from pick up 22 to filter 50 signals are also delivered over normal back contacts 25-1 of switch 25 to preamp 31, low-pass filter 32 and, in turn, to the parallel paths of inverting amplifier 37 and sampler 35. It is my discovery that the output of sampler 35, when scrambled speech is applied to its input, is similar to FIG. 4, i.e., a spectrum containing multiple, overlapping iterations of the inserted speech $I(\omega)$. In this case, however, the base band region from $-\omega_c$ to $+\omega_c$ contain the right hand half of $I(-2\omega\ s)$ and the left hand half of $I(+2\omega)$ which, together, reconstitute $F(\omega)$, the original base band speech. Inverting amplifier 37 causes the inverted speech component, $I(\omega)$ to be subtracted out of the base band spectrum in AND gate 38, leaving only the restored original speech $F(\omega)$ in the base band region. Low-pass filter 39 removes the multiple iterations of the inverted speech and, accordingly, only the restored original base band voice $F(\omega)$ is applied over normal back contacts 25-2 of switch 25 to earphones 13. Thus the wearer of the second helmet can understand what is being spoken by the wearer of the first helmet while bystanders hear only unintelligible noise.

It is a further aspect of the operation of the apparatus of FIG. 2 that when normal unscrambled speech is picked up by pick up 22 the signals will not produce sufficient energy to operate voltage control switch 52 and therefore sampler 35 will be inoperative. On the other hand, the normal speech signal delivery over normal back contacts 25-1 will be applied through preamplifier 31 and low pass filter 32 through inverting amplifier 37 in the open branch of circuitry 34 and thence through wired-AND gate 38 low pass filter 39 and back contacts 25-2 to earphones 13. Since the speech signals are simply inverted by amplifier 37 they will be completely intelligible to the listener. Accordingly, the wearer of the second helmet can understand both ordinary speech as well as scrambled speech without having to take any special action.

What has been described in illustrative of the principles of my invention, however, those skilled in the art will be able to make advantageous modification including, for example, substituting a voice-activated switch for manual switch 25. In addition, it should be apparent that the narrow band pass filter 50, integrating amplifier 51, and voltage control switch 52 can be replaced by a push-to-listen switch (not shown) that may be operated by the wearer of the second helmet when scrambled speech is heard for the purpose of connecting oscillator 36 to sampler 35 to unscramble the speech received over the air by pick-up 22. Further and other modifications will be apparent to those skilled in the art without departing from the principles of my invention.

I claim:

1. Apparatus for recoverably scrambling a speech signal, comprising:

filter means having a predetermined cutoff frequency, means for applying said speech signal to said filter means to produce an output, sample and hold means (35, 36) for sampling said output of said filter means at a sampling rate substantially equal to said cutoff frequency to produce sampled components, means (38) for subtracting from said sampled components a predetermined amplitude fraction of said original signal to produce an intermediate signal, means (53, 25-2) for adding to said intermediate signal an energy component at said sampling rate, and means (21) for transmitting to a receiving point said intermediate signal and said energy component.

2. Apparatus according to claim 1 further comprising a microphone source of said speech signals to be scrambled, said sample and hold means including switch means, and wherein said filter means having said predetermined cutoff frequency is connected between said microphone source and said switch means.

3. The combination of claim 2 wherein said means for subtracting includes an operational amplifier connected at the output of said filter means and means for ANDing the output of said operational amplifier with the output of said sample and hold means.

4. The combination of claim 3 wherein the gain of said operational amplifier is adjusted to cancel a predetermined base band component signal applied by said microphone source to said input of said filter means.

5. The combination of claim 3 wherein said apparatus for removing further comprises further low-pass filtering means at the output of said means for ANDing.

6. A communications system for use with a helmet comprising a first microphone for receiving sounds generated primarily within an enclosure defined by said helmet, a second microphone for receiving sounds picked up primarily outside said helmet enclosure, means for selectively low-pass filtering the outputs of said first and second microphones, means for sampling one of said selectively filtered microphone outputs at a rate determined by the cut-off frequency of said low-pass filtering means, means for substantially canceling a predetermined output component of said sampling means, an earphone for reproducing sounds within said enclosure, a loudspeaker for reproducing sounds external to said enclosure, and means for selectively connecting the output of said sampling means to said earphone and loudspeaker.

7. A communications system according to claim 6 wherein said sampling rate is substantially equal to the cut-off frequency of said low-pass filtering means.

8. A communications system according to claim 7 wherein said means for selectively connecting the output of said sampling means includes further low-pass filtering means.

9. A communications system according to claim 8 wherein said means for low-pass filtering said first and second microphones is a fourth order filter and said further low-pass filtering means comprises an eighth order filter.

10. A communications system for use with a helmet comprising a first microphone for receiving sounds generated primarily within an enclosure defined by said helmet, a second microphone for receiving sounds picked up primarily outside said helmet enclosure, an earphone for reproducing sounds within said enclosure, a loudspeaker for reproducing sounds external to said enclosure, scrambler/descrambler circuitry having an input and an output, and means for selectively connecting said input of said scrambler/descrambler circuitry to said first and second microphones and said output of said circuitry to said loudspeaker and said earphone.

* * * * *